US006901725B2

(12) United States Patent
Salicini et al.

(10) Patent No.: US 6,901,725 B2
(45) Date of Patent: Jun. 7, 2005

(54) METHOD AND WRAPPING WHEEL FOR CONDITIONING STACKS OF PRODUCTS

(75) Inventors: Sandro Salicini, Monterenzio (IT); Stefano Cavallari, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 143 days.

(21) Appl. No.: 10/419,695

(22) Filed: Apr. 21, 2003

(65) Prior Publication Data

US 2003/0230053 A1 Dec. 18, 2003

(30) Foreign Application Priority Data

Apr. 23, 2002 (IT) ..... BO2002A0222

(51) Int. Cl.[7] ..... B65B 11/30

(52) U.S. Cl. ..... 53/466; 53/225; 53/229; 53/234

(58) Field of Search ..... 53/466, 225, 227, 53/233, 234, 229, 374.7

(56) References Cited

U.S. PATENT DOCUMENTS

| | | | | | |
|---|---|---|---|---|---|
| 1,805,693 | A | * | 5/1931 | Gladeck | 53/234 |
| 1,818,497 | A | * | 8/1931 | Milmoe | 53/234 |
| 3,271,923 | A | * | 9/1966 | Fullbrook | 53/466 |
| 3,704,566 | A | * | 12/1972 | Zimmermann | 53/466 |
| 3,899,865 | A | * | 8/1975 | Revaz | 53/234 |
| 4,495,745 | A | * | 1/1985 | Crescenzo et al. | 53/234 |
| 4,617,782 | A | * | 10/1986 | Mattei et al. | 53/466 |
| 4,853,071 | A | * | 8/1989 | Romagnoli | 53/234 |
| 5,003,755 | A | * | 4/1991 | Draghetti | 53/466 |
| 5,775,063 | A | * | 7/1998 | Ikai et al. | 53/234 |
| 5,930,976 | A | * | 8/1999 | Boldrini et al. | 53/234 |
| 6,219,995 | B1 | * | 4/2001 | Boldrini et al. | 53/234 |

FOREIGN PATENT DOCUMENTS

| | | | |
|---|---|---|---|
| EP | 0771731 A1 | | 5/1997 |
| EP | 1177977 | | 2/2002 |
| GB | 623816 | | 5/1949 |
| GB | 206883 | * | 8/1981 |
| GB | 2068883 | | 8/1981 |

* cited by examiner

*Primary Examiner*—John Sipos
(74) *Attorney, Agent, or Firm*—Ladas & Parry

(57) ABSTRACT

On a wrapping machine for conditioning stacks of products, a stack of products is conditioned inside a tubular wrapping by folding a sheet of heat-seal wrapping material into a U about the stack inside a radial seat of a wrapping wheel, and by bringing two opposite lateral flaps of the U-folded sheet of wrapping material into contact with each other by means of a folding gripper, the jaws of which have respective end sealing members, and oscillate about an axis of rotation of the wrapping wheel to move with respect to each other to and from a closed position, and to accompany the radial seat along part of a travelling step of the wrapping wheel.

18 Claims, 4 Drawing Sheets

Fig.3
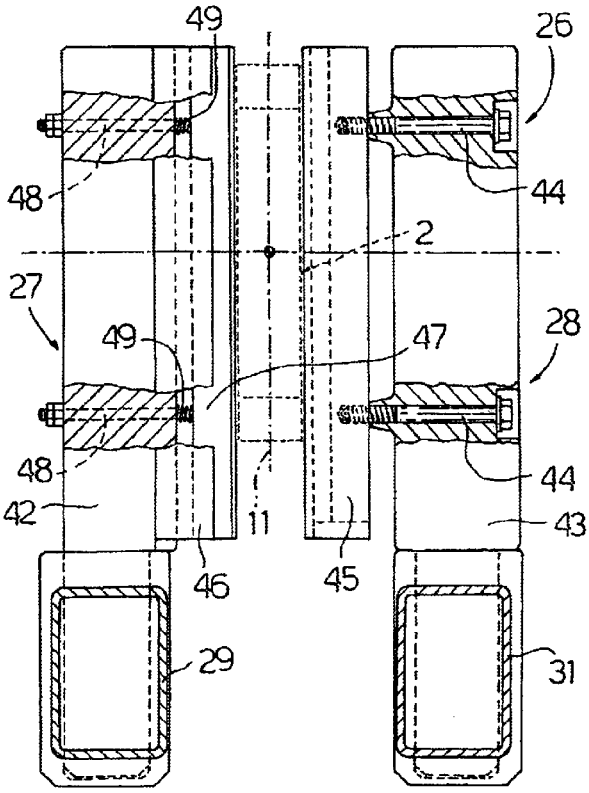
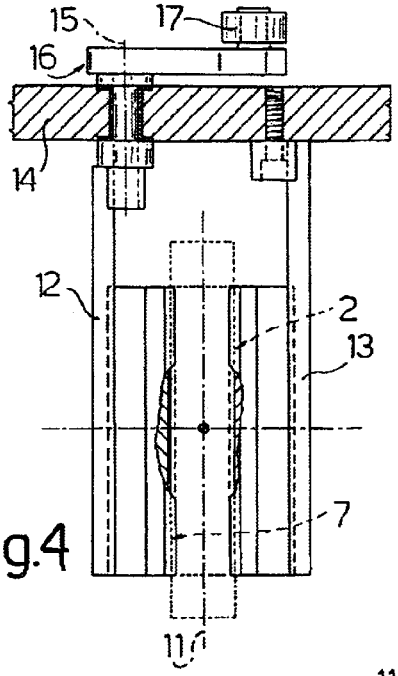
Fig.4
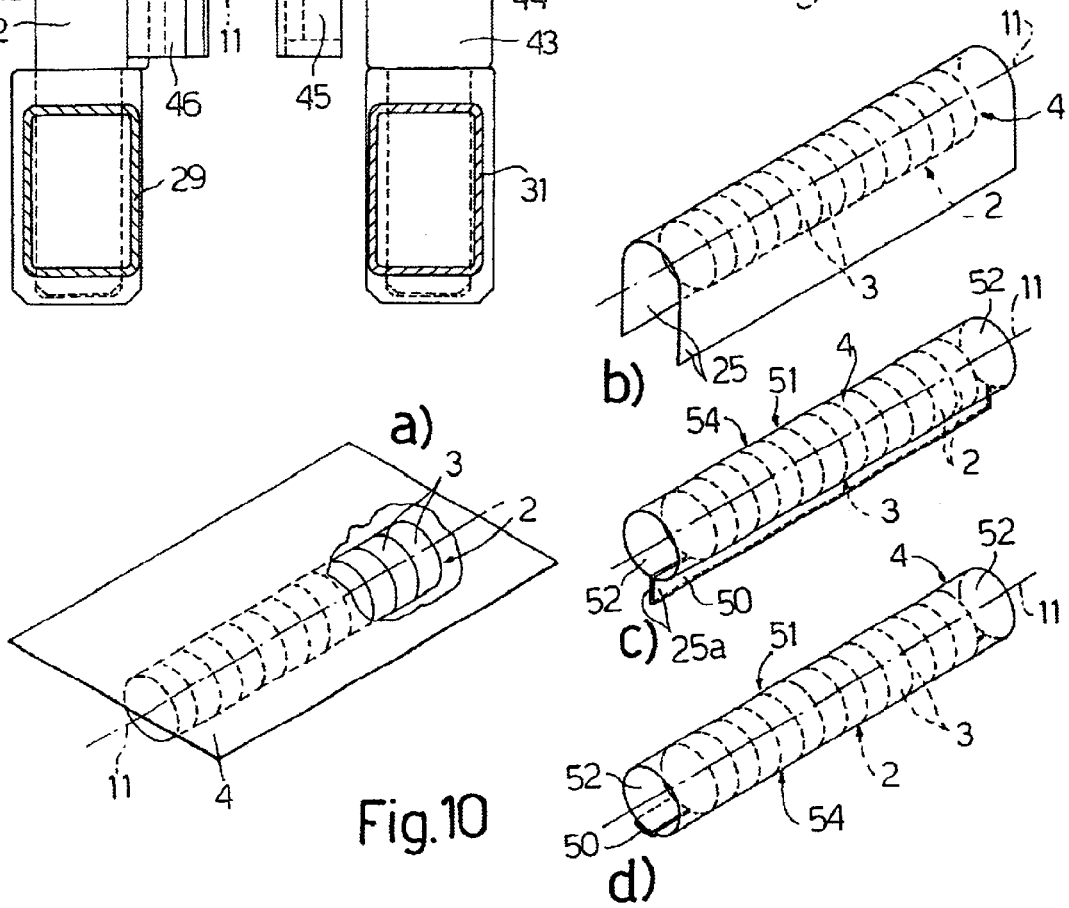
Fig.10

METHOD AND WRAPPING WHEEL FOR CONDITIONING STACKS OF PRODUCTS

The present invention relates to a wrapping method for conditioning stacks of products.

More specifically, the present invention relates to a wrapping method for conditioning stacks of products, of the type comprising a feed step, in which a stack of products is fed to a radial seat of a wrapping wheel rotating in steps about an axis of rotation to feed the radial seat in a given travelling direction and along an endless path extending through a stack loading station and an unloading station, the stack being positioned with its longitudinal axis parallel to said axis of rotation, and being fed to the radial seat through an output station of a feed line supplying heat-seal sheets of wrapping material, so as to mate with a respective sheet of wrapping material at said output station, and engage the relative radial seat while folding the relative sheet of wrapping material into a U with two opposite lateral flaps projecting from the relative stack and outwards of the radial seat; a first folding step, in which the two flaps are folded about the relative stack to define, about the stack, a tubular wrapping coaxial with said longitudinal axis and having a longitudinal rib defined by superimposed lateral end portions of said flaps; a sealing step, in which said lateral end portions are sealed to each other; and a second folding step, in which said rib is folded squarely onto an outer surface of the relative tubular wrapping.

The present invention is particularly advantageous for use on machines for wrapping stacks of sweets and similar, to which the following description refers purely by way of example.

BACKGROUND OF THE INVENTION

On known wrapping wheels, particularly for stacks of sweets, operating according to the above method, the two lateral flaps are normally folded together to form the longitudinal rib by a gripper on the relative radial seat, and are fed, so folded, to a sealing station where two opposite sealing devices grip the rib; the rib is released when the radial seat is started up again and leaves the sealing station; and the rib is folded squarely by a fixed folding member downstream from the sealing station.

In other words, the longitudinal rib is sealed during a stop of the relative radial seat at a sealing station, and so affects the output rate of the wrapping wheel as a whole. That is, sealing the longitudinal rib takes a relatively long time, normally longer than the follow-up folding and sealing operations performed by the wrapping wheel at other work stations, so that the stop times of the wrapping wheel must conform with those of the longest operation, thus reducing efficiency.

SUMMARY OF THE INVENTION

It is an object of the present invention to provide a wrapping method designed to eliminate the aforementioned drawback.

More specifically, it is an object of the present invention to perfect the above known wrapping method to minimize the stop times of the wrapping wheel.

According to the present invention, there is provided a wrapping method for conditioning stacks of products, as claimed in claim 1 and, preferably, in any one of the claims depending directly and/or indirectly on claim 1.

The present invention also relates to a wrapping wheel for conditioning stacks of products.

According to the present invention, there is provided a wrapping wheel for conditioning stacks of products, as claimed in claim 9 and, preferably, in any one of the claims depending directly and/or indirectly on claim 9.

BRIEF DESCRIPTION OF THE DRAWINGS

A non-limiting embodiment of the invention will be described by way of example with reference to the accompanying drawings, in which:

FIG. 3 shows a section along line III—III in FIG. 2;

FIG. 4 shows a section along line IV—IV in FIG. 2;

FIG. 10 shows views in perspective of a folding sequence performed by the FIG. 1 wrapping wheel.

DETAILED DESCRIPTION OF THE INVENTION

Figure 1:
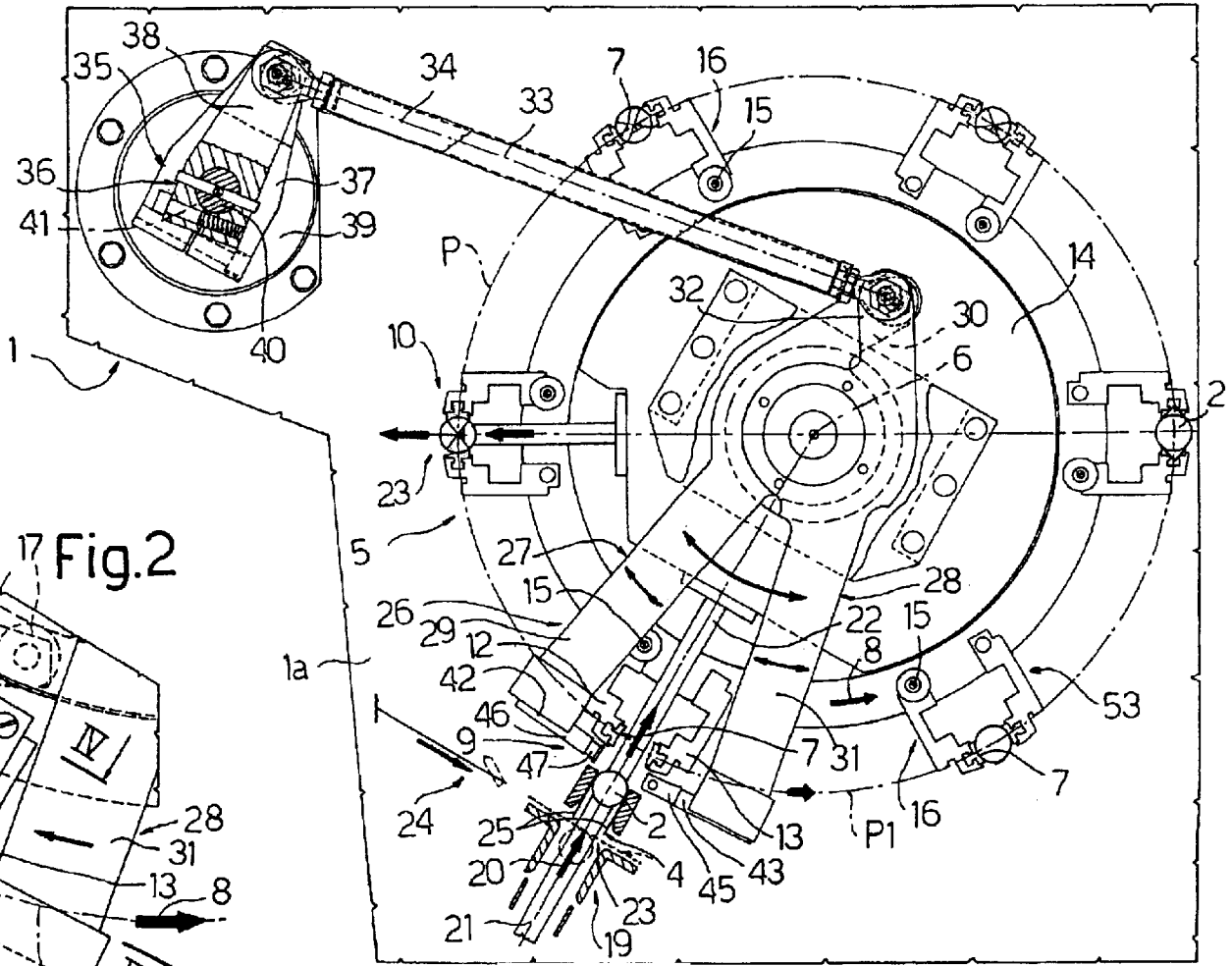
FIG. 1 shows a schematic side view, with parts removed for clarity, of a preferred embodiment of the wrapping wheel according to the present invention.

Number 1 in FIG. 1 indicates as a whole a wrapping machine for conditioning stacks 2 of sweets 3 by means of respective sheets 4 of heat-seal wrapping material.

Wrapping machine 1 comprises a wrapping wheel 5 fitted to a frame 1*a* to rotate (anticlockwise in the drawings) about a horizontal axis 6, and comprising a number of peripheral radial seats 7, which are fed in steps in a given travelling direction 8 and along an endless path P extending through a loading station 9 for loading stacks 2, and an unloading station 10 for unloading the wrapped stacks 2.

Figures 7, 8, 9:
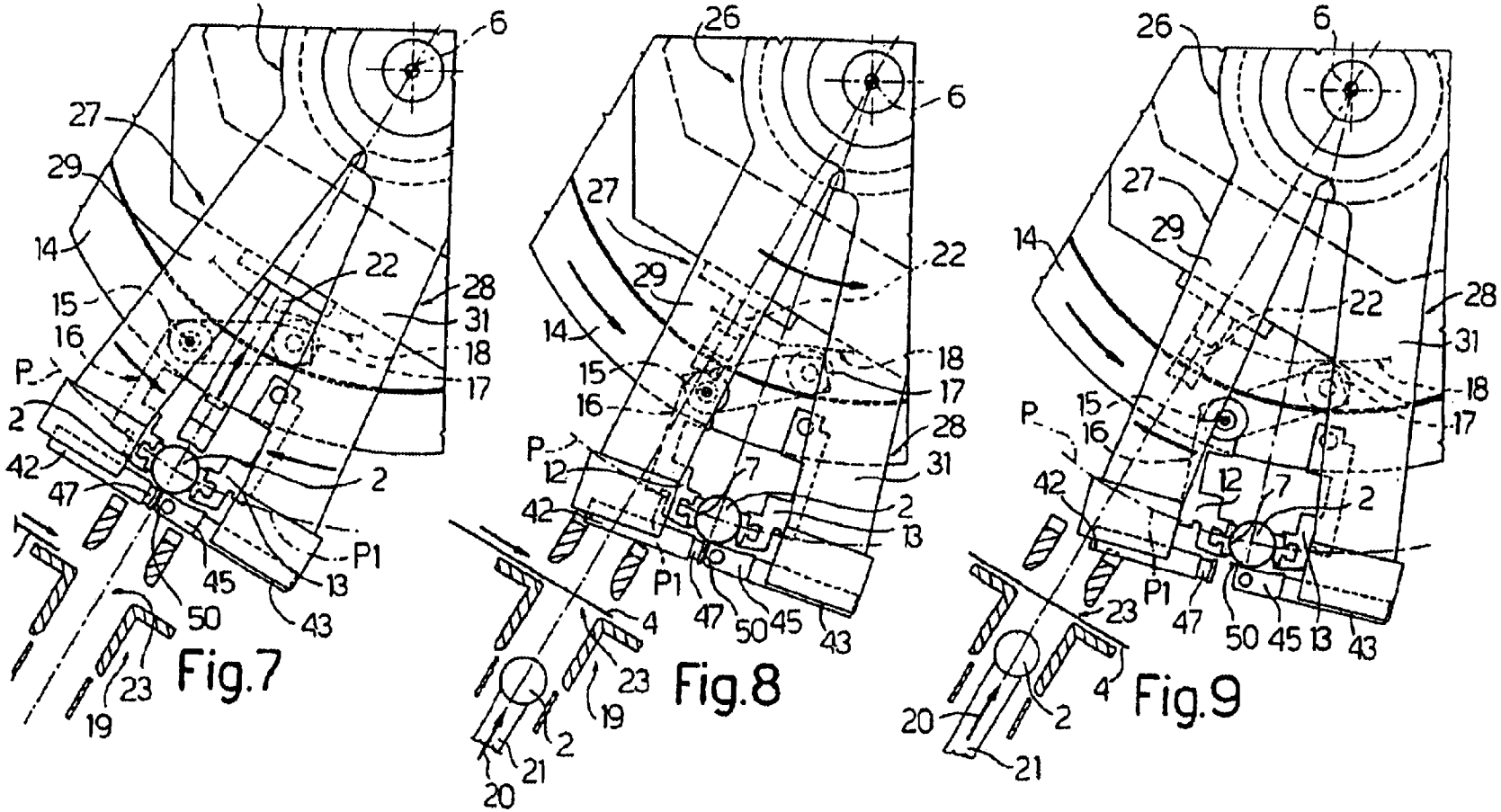

Each radial seat 7 receives a respective stack 2 positioned with a relative longitudinal axis 11 (FIG. 10) parallel to axis 6, and comprises two opposite jaws 12 and 13 for gripping a relative stack 2, and which extend outwards from the periphery of a central disk 14 of wrapping wheel 5. More specifically, jaw 12, located upstream from relative jaw 13 in travelling direction 8, is fitted to central disk 14 (FIG. 4) to rotate, with respect to central disk 14, about a relative axis 15 parallel to axis 6, and defines the outer arm of a rocker arm 16, an inner arm of which is fitted on the free end with a tappet roller 17 cooperating with a cam 18 (FIGS. 7–9) extending about axis 6 to control oscillation of jaw 12 to and from jaw 13, which is fixed.

Figure 6:
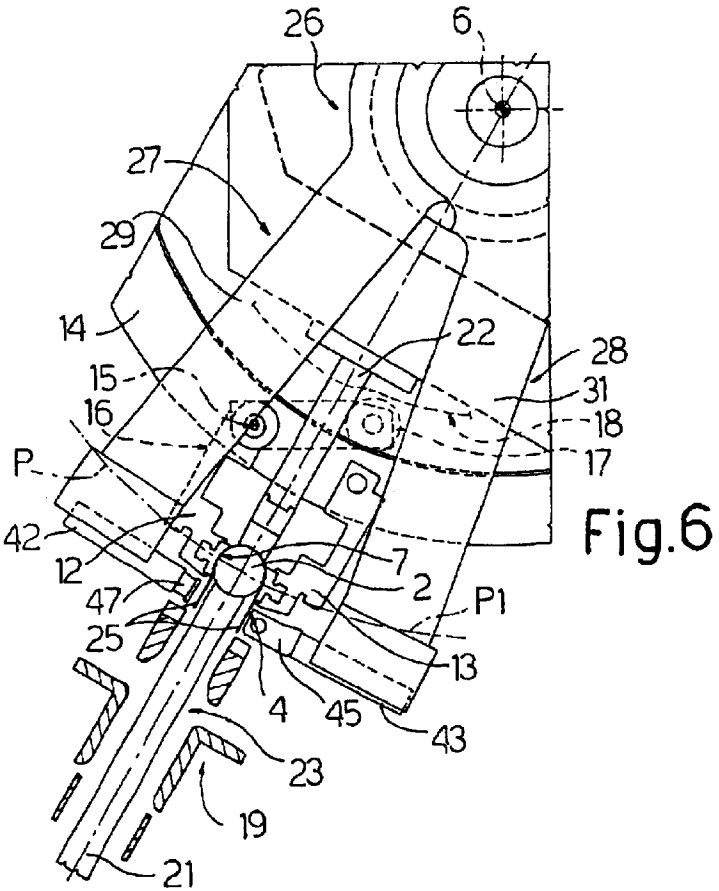
FIGS. 5 to 9 show the FIG. 2 detail in successive operating positions.
Figure 5:
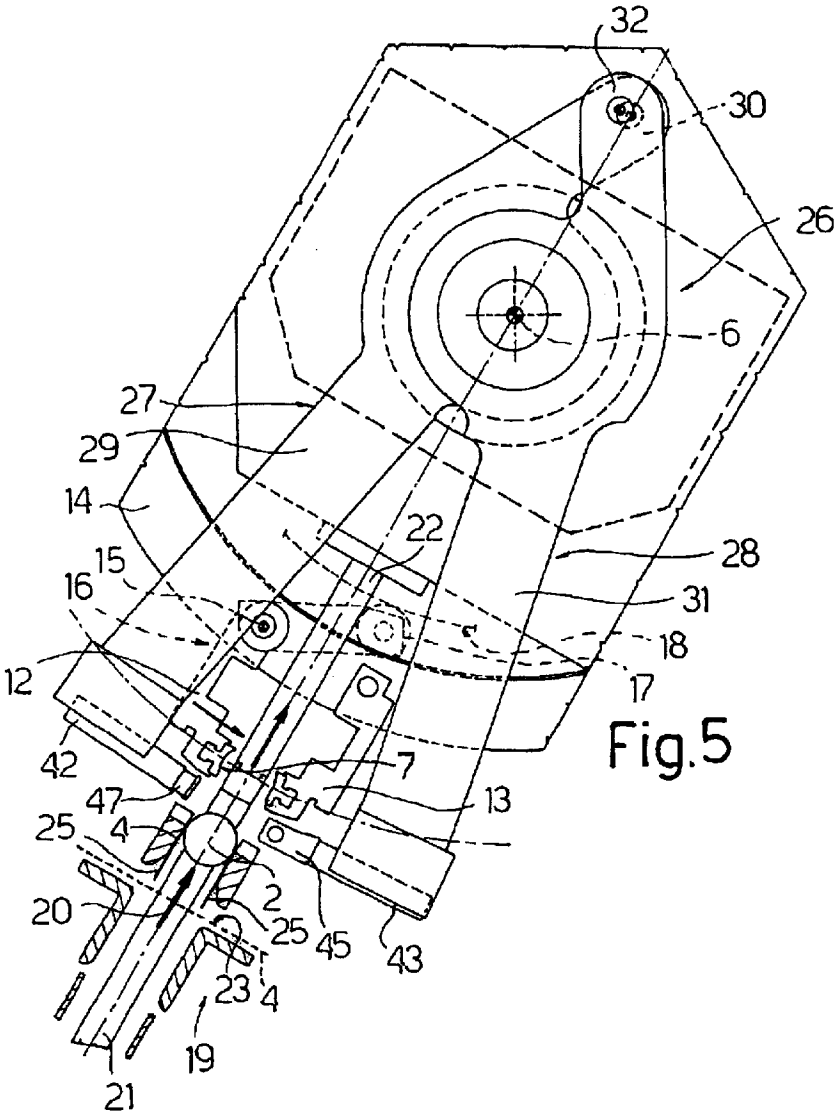

Each stack 2 is fed to loading station 9 along a radial conduit 19 and in a radial feed direction 20 by a pusher 21 outside wrapping wheel 5, and by a counterpusher 22 carried by a fixed central hub of wrapping wheel 5. Pusher 21 moves through an output station 23 of a feed line 24, supplying sheets 4 of wrapping material, to mate each stack 2 with a respective sheet 4 of wrapping material, and to push (FIG. 6) the whole so formed between jaws 12 and 13 of a relative radial seat 7 arrested at loading station 9. As each stack 2 and relative sheet 4 of wrapping material are pushed towards relative radial seat 7 arrested at loading station 9, relative sheet 4 of wrapping material is folded into a U with its concavity facing radially outwards, and with two opposite lateral flaps 25 of sheet 4 projecting rearwards from relative stack 2.

Wrapping wheel 5 has a folding gripper 26 comprising two rocker arms 27 and 28 pivoting about axis 6 and located in front of central disk 14 of wrapping wheel 5. Rocker arm 27, located upstream from rocker arm 28 in travelling direction 8, comprises a work arm 29 facing loading station 9, and defining a first jaw of folding gripper 26; and a control arm 30. Rocker arm 28 comprises a work arm 31 facing loading station 9 and arm 29, and defining a second jaw of folding gripper 26; and a control arm 32 overlapping arm 30. To the free ends of arms 30 and 32 are hinged respective output connecting rods 33 and 34 of respective actuating crank mechanisms 35 and 36 comprising respective cranks 37 and 38 hinged to relative connecting rods 33 and 34 and fitted to respective drive shafts 39 and 40 coaxial with each other and with an axis 41 parallel to axis 6 and outside path P. Drive shafts 39 and 40 oscillate differently about axis 41, as explained in detail later on, to impart oscillations to arms 29 and 31 along a portion P1 of path P extending in travelling direction 8 from loading station 9 and along a given arc as explained in detail later on.

Figure 2:
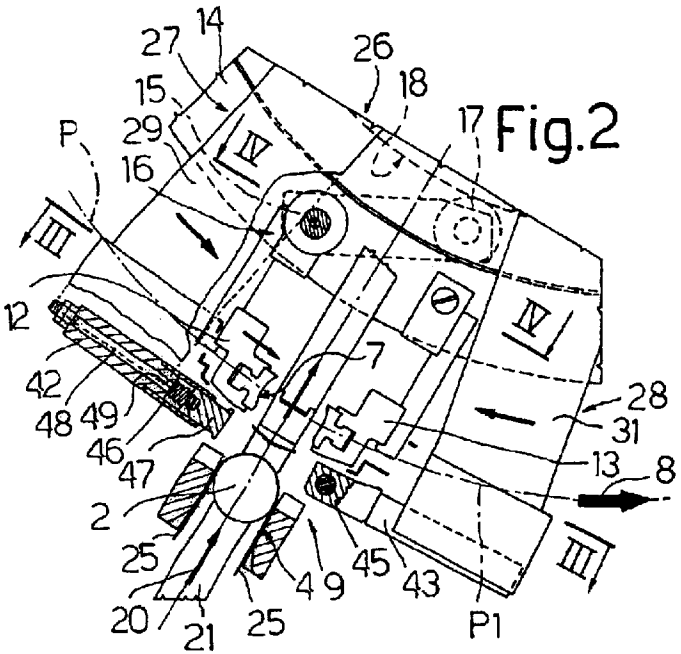
FIG. 2 shows a larger-scale detail of FIG. 1.

Arms 29 and 31 define the two jaws of folding gripper 26, and, as shown in FIGS. 2 and 3, are fitted integrally on their free ends with respective cross members 42 and 43 extending parallel to each other, alongside central disk 14, parallel to axis 6, and outside path P. On the side facing cross member 42, cross member 43 supports, in a fixed position and by means of screws 44, a sealing rod 45 located alongside disk 14, parallel to axis 6, and longer than stacks 2; and, on the side facing cross member 43, cross member 42 supports, in a fixed position, a U-shaped apron 46 for a sealing rod 47 facing and parallel to sealing rod 45, and fitted with two screws 48 fitted in sliding manner through cross member 42 to enable sealing rod 47 to move crosswise to its axis towards cross member 42 in opposition to springs 49 coaxial with screws 48 and compressed between sealing rod 47 and cross member 42.

In actual use, and with reference to FIGS. 1 and 5 to 10, when wrapping wheel 5 stops (FIG. 1) with a seat 7 at loading station 9, and with movable jaw 12 and folding gripper 26 both in the open position, a sheet 4 of wrapping material is laid across radial conduit 19 at output station 23. At this point, counterpusher 22 moves outwards into contact with sheet 4 of wrapping material, while pusher 21 moves in direction 20 towards wrapping wheel 5 to feed a stack 2 of sweets 3 along radial conduit 19 and into contact with sheet 4 of wrapping material. Pusher 21 and counterpusher 22 then move together in direction 20 to feed the whole defined by stack 2 and relative sheet 4 of wrapping material to seat 7. In the course of which movement, sheet 4 of wrapping material, held contacting relative stack 2 by the opposing action of pusher 21 and counterpusher 22, is folded into a U about relative stack 2 (FIGS. 5 and 10*b*), and is still in this position on reaching relative seat 7. When movable jaw 12 closes (FIG. 6), sheet 4 is positioned inside relative seat 7 with lateral flaps 25 projecting outwards from seat 7 and between the two sealing rods 45 and 47.

Before pusher 21 and counterpusher 22 part to release stack 2 inside relative seat 7, drive shafts 39 and 40 are operated to cause folding gripper 26 to perform a relatively small first closing movement (between FIGS. 6 and 7 and not shown) to fold lateral flaps 25 slightly about relative stack 2 (while still leaving pusher 21 free) and prevent sweets 3 from falling when pusher 21 is detached.

Once pusher 21 is withdrawn past output station 23, folding gripper 26 completes the closing movement (FIG. 7), so that sealing rods 45 and 47 are brought into contact compressing springs 49, and two end portions 25*a* of lateral flaps 25 are brought into contact to define (FIG. 10*c*) a longitudinal fin or rib 50 closing a tubular wrapping 51, which is coaxial with longitudinal axis 11 of relative stack 2, and has two opposite ends 52 projecting outwards of respective ends of relative stack 2. Only at this point do sealing rods 45 and 47—which, though heated, have so far operated substantially as straightforward folding devices—begin operating as sealing devices to seal longitudinal rib 50 closing tubular wrapping 51.

Wrapping wheel 5 (FIG. 8) then moves in travelling direction 8 to feed seat 7 to the next work station 53; and drive shafts 39 and 40 are operated to keep folding gripper 26 in the closed position, while at the same time enabling folding gripper 26 to follow seat 7 along portion P1, which extends along an arc centred about axis 6 and generally shorter than the arc between two adjacent seats 7. Sealing of rib 50 can thus continue downstream from loading station 9 to reduce the stop times of wrapping wheel 5.

Once rib 50 is sealed, folding gripper 26 is arrested and opened to release rib 50, which (FIGS. 9 and 10*d*) is folded backwards onto a lateral surface 54 of relative tubular wrapping 51 on striking sealing rod 45, which in this case acts as a fixed folding device.

When the wrapped stack 2 passes the end of portion P1, folding gripper 26, still in the open position, is restored to its original position in FIG. 1.

What is claimed is:

1. A method of wrapping stacks (2) of products (3), the method comprising a feed step, in which a stack (2) of products (3) is fed to a radial seat (7) of a wrapping wheel (5) rotating in steps about an axis of rotation (6) to feed said radial seat (7) in a given travelling direction (8) and along an endless path (P) extending through a loading station (9) for loading said stack (2), and through an unloading station (10), said stack (2) being positioned with its longitudinal axis (11) parallel to said axis of rotation (6), and being fed to said radial seat (7) through an output station (23) of a feed line (24) supplying heat-seal sheets (4) of wrapping material, so as to mate with a respective said sheet (4) of wrapping material at said output station (23), and engage said radial seat (7) while folding said sheet (4) of wrapping material into a U with two opposite lateral flaps (25) projecting from the relative said stack (2) and outwards of said radial seat (7); a first folding step, in which said two lateral flaps (25) are folded about the relative said stack (2) to define, about the stack (2), a tubular wrapping (51) coaxial with said longitudinal axis (11) and having a longitudinal rib (50) defined by superimposed lateral end portions (25*a*) of said lateral flaps (25); a sealing step, in which said lateral end portions (25*a*) are sealed to each other; and a second folding step, in which said longitudinal rib (50) is folded squarely onto an outer surface (54) of said tubular wrapping (51); and being characterized in that said two folding steps and said sealing step are performed by folding means (26) comprising two opposite sealing members (45, 47), which perform respective movements to move with respect to each other to and from a closed position contacting each other, and to accompany said radial seat (7) along a portion (P1) of said path (P) during the folding and sealing steps.

2. A method as claimed in claim 1, wherein said portion of the path (P1) is less than one travelling step of the wrapping wheel (5).

3. A method as claimed in claim 1, wherein said portion (P1) of the path (P) extends in said travelling direction (8) from said loading station (9).

4. A method as claimed in claim 1, wherein said movements of said sealing members (45, 47) are oscillations about said axis of rotation (6).

5. A method as claimed in claim 1, wherein said folding means (26) comprise a folding gripper (26) having two jaws (29, 31) mounted to oscillate about said axis of rotation (6)

by virtue of respective actuating means (39, 35; 40, 36); each said jaw (29; 31) being fitted with a respective said sealing member (47; 45).

6. A method as claimed in claim 1, wherein said first folding step is performed by said sealing members (45, 47) when said radial seat (7) is arrested at said loading station (9).

7. A method as claimed in claim 1, wherein said sealing step is at least partly performed by said sealing members (45, 47) in the course of one travelling step of said wrapping wheel (5).

8. A method as claimed in claim 1, wherein said second folding step is performed by said longitudinal rib (50) striking one (45) of said sealing members (45, 47).

9. A wrapping wheel for conditioning stacks (2) of products (3), the wrapping wheel (5) being mounted to rotate about an axis of rotation (6), and comprising a number of radial seats (7), which are fed in steps in a given travelling direction (8) and along an endless path (P) extending through a loading station (9) for loading said stacks (2), and through an unloading station (10), and which receive respective said stacks (2) positioned with respective longitudinal axes (11) parallel to said axis of rotation (6); feed means (21, 22) for feeding each said stack (2) to a relative said radial seat (7) at said loading station (9) and through a feed line (24) supplying heat-seal sheets (4) of wrapping material, so as to mate each said stack (2) with a respective said sheet (4) of wrapping material, and engage the relative said radial seat (7) while folding the relative said sheet (4) of wrapping material into a U about the relative said stack (2), and with two opposite lateral flaps (25) projecting from the relative said stack (2) and outwards of said radial seat (7); and folding means (26) for folding said two lateral flaps (25) about the relative said stack (2) to define, about the stack (2), a tubular wrapping (51) coaxial with the relative said longitudinal axis (11) and having a longitudinal rib (50) defined by superimposed lateral end portions (25*a*) of said lateral flaps (25), and for folding said longitudinal rib (50) squarely onto an outer surface (54) of the relative said tubular wrapping (51); and being characterized in that said folding means (26) comprise two opposite sealing members (45, 47) for sealing said lateral portions which perform respective movements to move with respect to each other to and from a closed position contacting each other, and to accompany said radial seat (7) along a portion (P1) of said path (P) during the folding and sealing operations.

10. A wrapping wheel as claimed in claim 9, wherein said portion (P1) of the path (P) is less than one travelling step of the wrapping wheel (5).

11. A wrapping wheel as claimed in claim 9, wherein said portion (P1) of the path (P) extends in said travelling direction (8) from said loading station (9).

12. A wrapping wheel as claimed in claim 9, wherein said movements of said sealing members (45, 47) are oscillations about said axis of rotation (6).

13. A wrapping wheel as claimed in claim 9, wherein said folding means (26) comprise a folding gripper (26) having two jaws (29, 31) mounted to oscillate about said axis of rotation (6) by virtue of respective actuating means (39, 35; 40, 36); each said jaw (29; 31) being fitted with a respective said sealing member (47; 45).

14. A wrapping wheel as claimed in claim 13, wherein each jaw (29; 31) is defined by a first arm (29; 31) of a respective rocker arm (27; 28) pivoting about said axis of rotation (6); each rocker arm (27; 28) comprising a second arm (30; 32) connected to the respective said actuating means (39, 35; 40, 36).

15. A wrapping wheel as claimed in claim 14, wherein each said actuating means (39, 35; 40, 36) comprises a powered connecting rod-crank crank mechanism (35; 36).

16. A wrapping wheel as claimed in claim 14, wherein each said sealing member (45; 47) comprises a respective sealing rod (45; 47) extending parallel to said axis of rotation (6).

17. A wrapping wheel as claimed in claim 14, wherein each sealing member (45; 47) is connected to a free end of the relative first arm (29; 31) of the relative rocker arm (27; 28).

18. A wrapping wheel as claimed in claim 17, wherein one (47) of said sealing members (45, 47) is connected to the free end of the relative first arm (29; 31) of the relative said rocker arm (27; 28) via the interposition of springs (49) positioned crosswise to the sealing member (47).

* * * * *